US009243868B1

(12) United States Patent
Nigro

(10) Patent No.: US 9,243,868 B1
(45) Date of Patent: Jan. 26, 2016

(54) RETICLE PROVIDING MAXIMIZED DANGER SPACE

(71) Applicant: The United States of America, as Represented by the Secretary, Department of Homeland Security, Washington, DC (US)

(72) Inventor: Michael A. Nigro, El Paso, TX (US)

(73) Assignee: The United States of America, as Represented by the Secretary, Department of Homeland Security, Washington, DC (US)

( * ) Notice: Subject to any disclaimer, the term of this patent is extended or adjusted under 35 U.S.C. 154(b) by 0 days.

(21) Appl. No.: 14/570,346

(22) Filed: Dec. 15, 2014

(51) Int. Cl.
*F41G 1/00* (2006.01)
*F41G 3/00* (2006.01)

(52) U.S. Cl.
CPC ..... *F41G 3/00* (2013.01)

(58) Field of Classification Search
CPC ..... F41G 1/12; F41G 3/00; G01C 3/16
USPC ..... 42/130
See application file for complete search history.

(56) References Cited

U.S. PATENT DOCUMENTS

| | | | | | |
|---|---|---|---|---|---|
| 2,154,454 | A * | 4/1939 | Joyce | 42/122 |
| 2,171,571 | A * | 9/1939 | Karnes | 42/123 |
| 3,392,450 | A * | 7/1968 | Herter et al. | 42/122 |
| 3,948,587 | A * | 4/1976 | Rubbert | 356/21 |
| 4,263,719 | A * | 4/1981 | Murdoch | 33/297 |
| 4,912,853 | A * | 4/1990 | McDonnell et al. | 33/228 |
| 6,032,374 | A * | 3/2000 | Sammut | 42/122 |
| 6,453,595 | B1 * | 9/2002 | Sammut | 42/130 |
| 7,171,775 | B1 * | 2/2007 | Lacorte | 42/122 |
| 2002/0124452 | A1 * | 9/2002 | Sammut | 42/122 |
| 2005/0229468 | A1 * | 10/2005 | Zaderey et al. | 42/122 |
| 2005/0257414 | A1 * | 11/2005 | Zaderey et al. | 42/122 |
| 2006/0236586 | A1 * | 10/2006 | Zaderey | 42/133 |
| 2009/0199451 | A1 * | 8/2009 | Zaderey et al. | 42/122 |
| 2014/0305025 | A1 * | 10/2014 | Tubb | 42/130 |

OTHER PUBLICATIONS

Long Range Hunting Online Magazine, Long Range Hunting & Shooting, Mil-Dot Ranging Elk and Deer, 9 pages, http://www.longrangehunting.com/forums/f17/mil-dot-ranging-elk-deer-46434/.

Eotech Electro-Optics Technologies, EOTech HWs 511-552 User Manual, World's First Holographic Site, 4 pages, User Manual.

* cited by examiner

*Primary Examiner* — Samir Abdosh
(74) *Attorney, Agent, or Firm* — Lavanya Ratnam; Nathan Grebasch; William Washington

(57) ABSTRACT

A reticle for a projectile weapon aiming apparatus including a plurality of aiming marks, the plurality of aiming marks include a first mark positioned at the center of the reticle and at least one additional mark spaced below the first mark along a vertical center axis of the reticle, wherein adjacent marks of the first mark and the at least one additional mark are spaced apart by predetermined distances. First and second horizontal stripes are provided on each side of the plurality of aiming marks respectively, the first and second horizontal stripes offset relative to the vertical center axis with a gap provided therebetween and extending towards the perimeter of the reticle, the first and second horizontal stripes spaced a predetermined distance from a bottom of the reticle measured along the vertical center axis.

9 Claims, 16 Drawing Sheets

RETICLE PROVIDING MAXIMIZED DANGER SPACE

BACKGROUND

1. Field of the Disclosure

This specification relates to an optical weapon sight, and more particularly to the internal aiming component such as a reticle.

2. Description of the Related Art

Optical weapon sights are equipped with a sighting assembly which includes a reticle. A reticle serves as an aiming reference guide for a target engagement situated at various distances. The weapon sights and the reticle therein follow different design methods, and can have various sizes, shapes and forms. For example, the EOTech Holographic Weapon Sight ("HWS") is a proprietary weapon sight that utilizes combined ranging and aiming in one image, via a heads-up display that has a wide field of view for situational awareness which helps with speed in target acquisition. In general, such weapon sights can be broadly classified into two categories: Short range and Multi-purpose.

Short range weapon sights may include a reticle that has a reflex, circle dot, or red-dot configuration. An operator places the dot on the target and fires. This type of optic is typically utilized in close quarters combat environments and basic patrolling operations. The advantage to this type of optic is ease of use, small size, light weight and speed. Disadvantages of this type of optical sight include limited capability when engaging extended range targets.

Multi-Purpose weapon sights include a reticle with subtensions that designate an aiming reference according to a specific distance of a target. The disadvantage to this type of sight is that the reticle is calibrated for a specific caliber and weight ammunition, at a specific muzzle velocity, at a specific altitude and several other parameters. If the operator is not utilizing the identical weapon/ammunition combination, and is operating at a different altitude, accurate shot placement may be compromised. Additionally, in most dynamic situations, the operator does not know the range to a target to employ the correct aiming reference. Multi-Purpose weapon sights optics are typically expensive and do not offer the speed of use of the short range weapon sights.

SUMMARY

The present disclosure is directed to a multi-purpose weapon sight for close to long-range targets. The exemplary reticle embodiments described herein provide a standardized yet simple weapon sighting solution which can be calibrated for use on different caliber weapons. The calibration (zeroing) method employed according to the present disclosure accounts for the ammunition weight/muzzle velocity variable, and the altitude at which the weapon is fired. In addition, the reticle embodiments described can provide the operator with simple firing solutions for human targets and other targets at unknown distance. Multiple aiming dots and windage compensation features can assist an operator in target acquisition quickly and accurately.

The disclosed embodiments follow a danger space based reticle calibration methodology as opposed to trajectory based calibration enabling the standardization of weapon sighting.

The forgoing general description of the illustrative implementations and the following detailed description thereof are merely exemplary aspects of the teachings of this disclosure, and are not restrictive.

DETAILED DESCRIPTION

Figure 1:
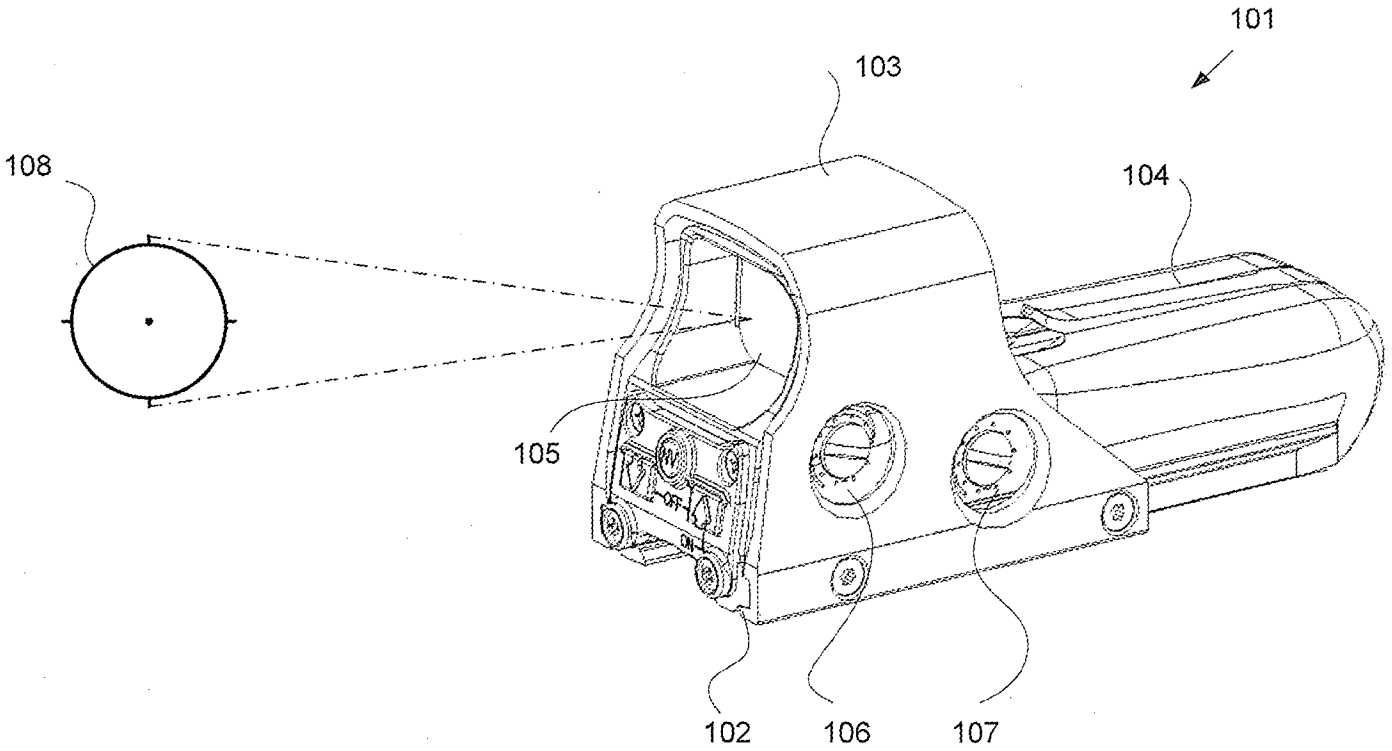
FIG. 1 Background Art
FIG. 1 illustrates the proprietary EOTech HWS. The mounting hardware includes a universal mount, optical assembly with a viewing window, elevation adjustment, and a windage adjustment.

In the drawings, like reference numerals designate identical or corresponding parts throughout the several views. Further, as used herein, the words "a", "an" and the like generally carry a meaning of "one or more", unless stated otherwise. The drawings are generally drawn to scale unless specified otherwise or illustrating schematic structures or flowcharts.

Furthermore, the terms "approximately," "proximate," "minor," and similar terms generally refer to ranges that include the identified value within a margin of 20%, 10% or preferably 5%, and any values therebetween.

In the drawings or figures, the terms "left", "right", "vertical", and "horizontal" are based on a viewing perspective of the figure such that the captions are located approximately at the center and below a drawing. The term "left" refers to the part of the figure on the left side of the drawing with the caption (e.g., "FIG. 1") located at the bottom of the figure. The term "right" refers to the part of the figure on the right side of the drawing with the caption located at the bottom of the figure.

The exemplary dimensions of the reticle, discussed in the embodiment of the present disclosure, follows US system of units such as yards, inches, etc., however, it is possible to design the reticle dimensions in other unitary systems such as the metric system using relevant conversion formula.

Referring to FIG. 1, a HWS or a ballistic weapon sighting device 101 is mounted on a weapon receiver. The HWS includes a mount 102, an optical housing 103 including an optical lens assembly (shown in FIG. 2), a battery compartment 104, a viewing window 105, elevation adjustment 106, and windage adjustment 107. The optical lens assembly includes a reticle 108, which is visible through the viewing window 105. The elevation adjustment and the windage adjustment are used during an initial calibration (zeroing)

process. Once the weapon sight is zeroed, the elevation adjustment and the windage adjustment 107 should stay in a fixed position.

Figure 2:
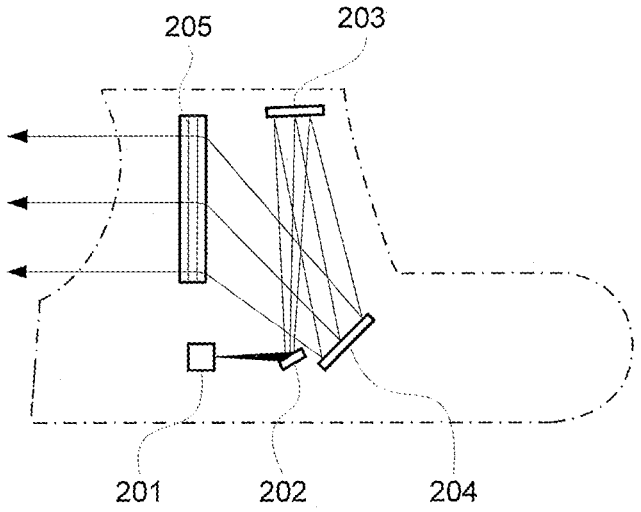
FIG. 2 Background Art
FIG. 2 depicts the proprietary EOTech HWS optical assembly. The exemplary light rays are exaggerated for illustration purposes.

FIG. 2 illustrates an optical lens assembly used in the HWS. A laser diode 201 projects light on an inclined reflector 202. The reflected light is directed on to a collimating reflector 203 which generates parallel light rays directed on to the holographic grating 204. The light is then diffracted from the holographic grating 204 on to the lens containing a reticle image hologram 205. This holographic of the reticle image then becomes visible through the viewing window 105 (FIG. 1).

Other than the HWS reticle, alternate optical lens assemblies with similar reticles may be implemented. For example, alternate lens assemblies are of the reflective or telescopic type, etc. Additional features such as illumination or colors may be added to a reticle.

Figure 3A:
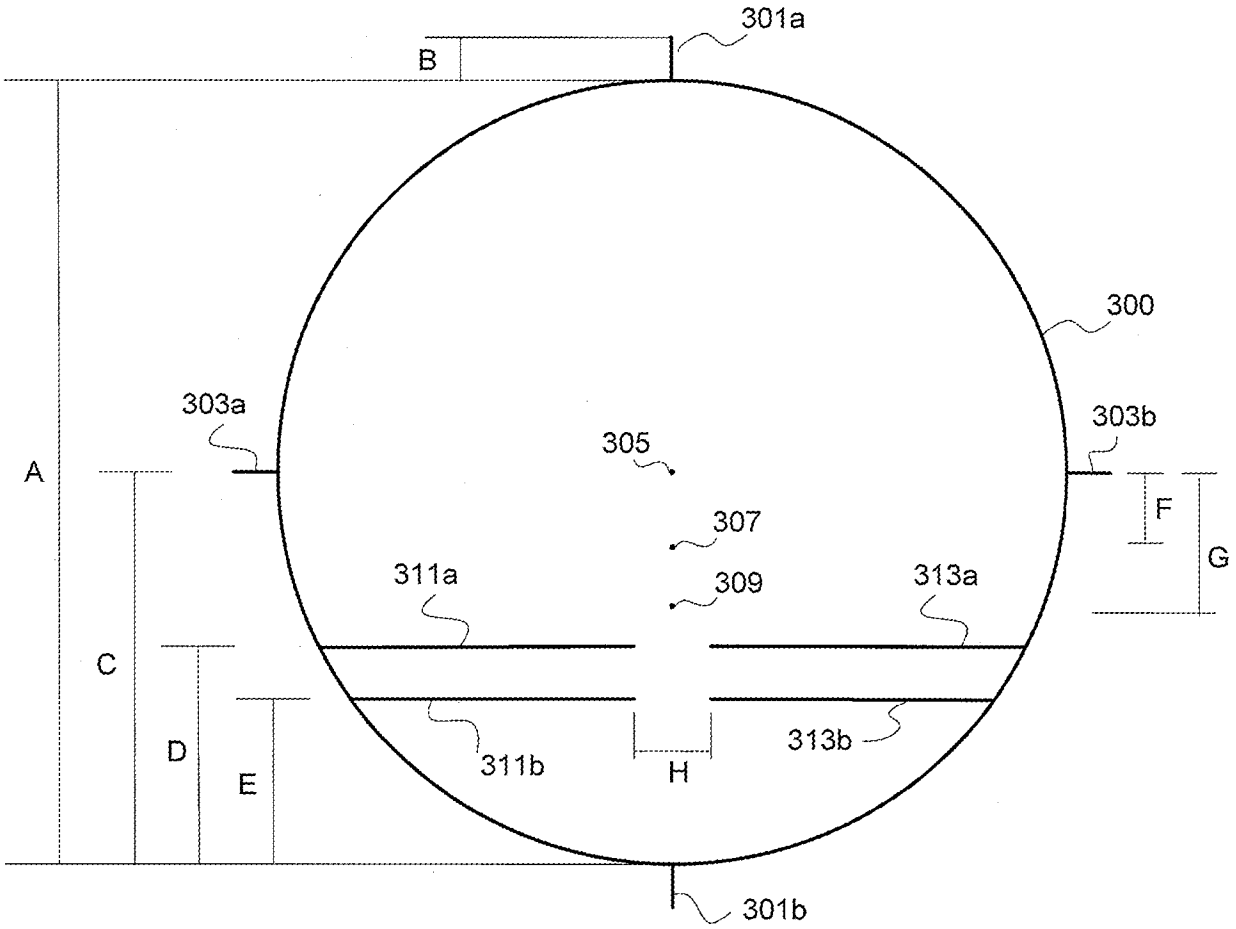
FIGS. 3A and 3B illustrate reticles according to the detailed description below implemented in traditional optical sights and HWS, respectively.
Figure 3B:
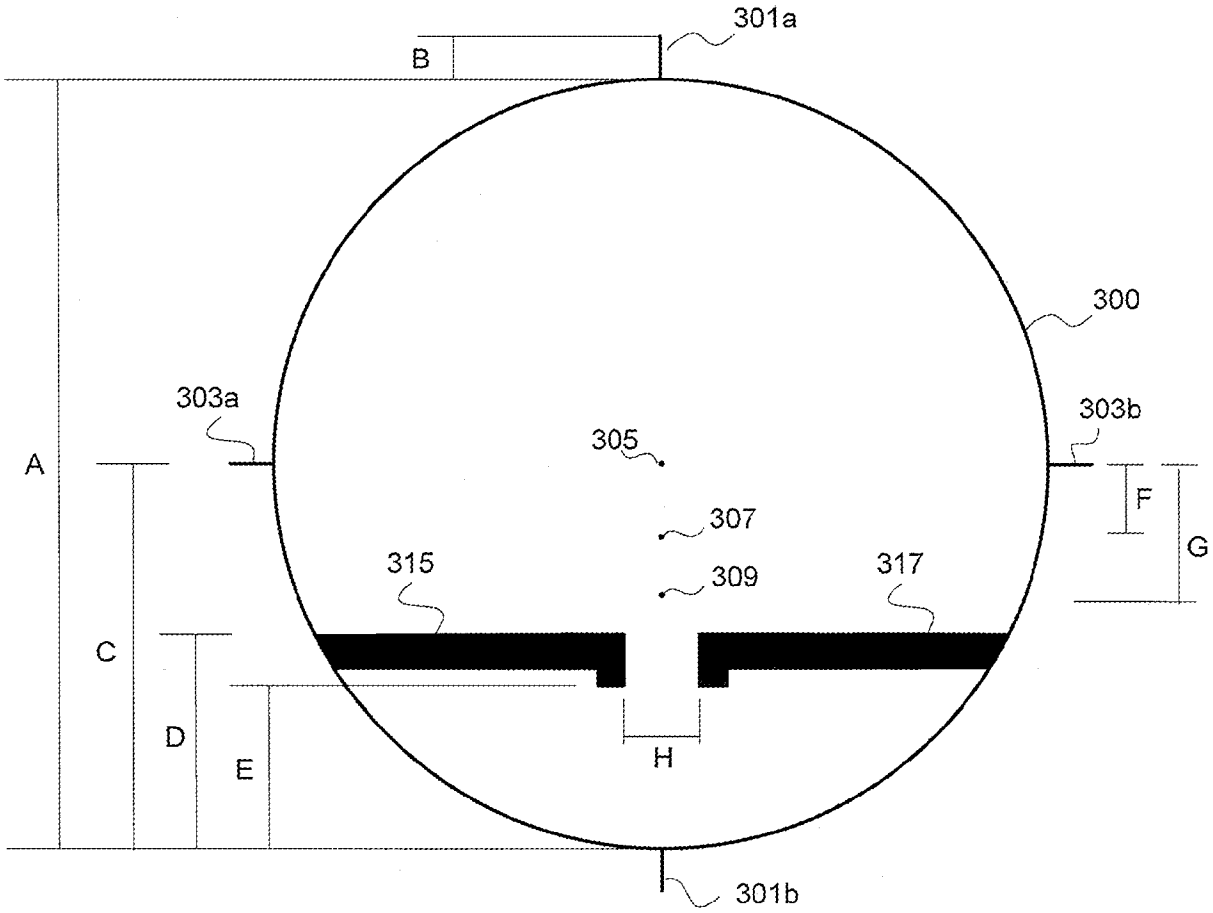

FIG. 3B illustrates an exemplary reticle according to the present disclosure that can be used in the HWS sighting device 101. The reticle includes a circle 300 with four lines 301*a*, 301*b*, 303*a*, and 303*b* extending in an outward direction (away from the circumference). The lines 301*a* and 301*b* indicate the vertical center axis and the lines 303*a* and 303*b* indicate the horizontal center axis. Inside the circle 300, along the vertical center axis (not marked) more than one dot may be marked. The dots 305, 307, and 309 are the primary aiming dots. The first primary aiming dot 305 is provided at the center of the circle (i.e., at an intersection of the horizontal and vertical center axis of the circle). The primary aiming dots 307 and 309 are placed below the primary aiming dot 305 along the vertical center axis at varying distance. The distances between primary dots 305 and 307 and primary dots 307 and 309, respectively, are determined based on ballistic methodology and mil-formula discussed below.

The left and the right side of the primary aiming dots may include additional marks such as stripes. For example, the reticle for the optical sight illustrated in FIG. 3A, the stripes include two sets of parallel lines 311*a* and 311*b* and 313*a* and 313*b* which are oriented horizontally below the primary aiming dot 305. The horizontal lines on each side of the vertical center axis are substantially parallel to each other and spaced at a predetermined distance. The design and dimensions of the stripes of the reticle correlate to a ballistic solution method disclosed below.

An alternate stripe pattern for implementation in a reticle for the HWS sight is shown in FIG. 3B. Here, exemplary stripes 315 and 317 have a thick horizontal line with downward facing feet. The feet of the stripes 315 and 317 are offset from the vertical center axis and have a predetermined length. A minimum thickness of the horizontal lines 315 and 317 that can be currently achieved in some embodiments is 3 MOA (3.141 inches at 100 yards) with no maximum limit. The thickness of the horizontal lines can be selected as a function of design and manufacturing constraints. Other considerations include sizing the thickness of lines based on anthropomorphic factors. For example, a design constraint could be to provide a 1 MIL measurement reference based on various factors such as the intensity of light from the reticle, or an anticipated eye stress level of an operator. Further, the 1 MIL measurement reference can be used as a scale to measure the height of a target. For instance, the 1 MIL horizontal line 315 can be placed at the lowermost part of the target and moved upwards in incremental steps until the topmost part of the target is reached. Then, using the conversion formula for mil units, an approximate target height can be determined.

In embodiments, the thickness of the horizontal line is selected so one side of the line is at or substantially at one third, or thirty-three percent (33%), of the vertical space while a second side of the line is at or substantially at one quarter or, twenty five percent (25%), of the vertical space. In embodiments in which two lines on each respective side are used (e.g., two on a right side of a target and two on the left side), the individual lines are aligned in the circle at the foregoing positions and spaced apart accordingly.

The features of the exemplary reticles illustrated in FIGS. 3A and 3B can have multiple functions. Referring to FIG. 3B, the circle 300 and the four lines 301*a*, 301*b*, 303*a*, and 303*b* act as a target funneling feature, which enables the operator to focus on the target quickly and with minimal effort. The four lines further act as a guide to vertical and horizontal indexing of the weapon without obstructing the light coming into the scope and thus a clear and unobstructed image of the target can be seen in the illustrated embodiment. The circle 300, and reference lines in FIG. 3A (311*a*, 311*b*, 313*a*, 313*b*) and 3B (315, 317) are deliberately sized for range estimation (or categorizing) of human targets according to a mil-relation formula. This is to say the mean or an anthropomorphic average of human torsos.

The primary aiming dots 305, 307, and 309 can serve at least two purposes. First, the dots can serve as an aiming point for a target within three predetermined ranges and secondly, as a target range measuring tool. Target range is a horizontal distance measured from the optical sight or weapon to the target. The primary aiming dots 305, 307, and 309 are calibrated to correlate to fixed range estimation/target categorization calculations for the three designed range spans. The term "danger space" as generally used herein refers to a horizontal distance range within which a target will be hit by ammunition fired through a weapon. Within the context of firing a weapon at a practice range, the "target" is typically a twenty-four inch by eighteen inch reference standard (hereinafter "24" standard") which represents a human torso.

Weapon-ammunition combinations can have different ballistic characteristics such as a different danger space and a different optimized zero (discussed below with reference to FIG. 4). There exist a myriad of such weapon-ammunition combinations. For any weapon-ammunition combination, after the weapon and sight have been optimized (e.g., adjusted to have a maximized danger space), the primary aiming dots 305, 307, and 309 are standardized so a target in the designed range will always be engaged. While engaging a target within the designed range, the operator simply points and shoots at the target. The operator does not need to manually adjust the (sight or device), such as by turning knobs or screws to adjust for elevation or windage. In embodiments, a user can compensate for target distance, elevation, windage and combinations thereof without manually adjusting the sight, e.g., adjusting knobs, screws, etc.

Primary aiming dots 305, 307, and 309 can also used as a target range measuring tool. The target range can be estimated by positioning the target's vital area (such as a human torso) between two adjacent primary aiming dots. The distances between the primary aiming dots 305 and 307 and 307 and 309, respectively, are calibrated such that, when a target is positioned between primary dots 305 and 307 along an imaginary vertical axis, the distance to the target is within a certain designed range (such as 0-330 yards). When a target is positioned between dots 307 and 309 along a vertical axis, the distance to the target is within a different designed range (such as 325-450 yards).

Figure 5A:
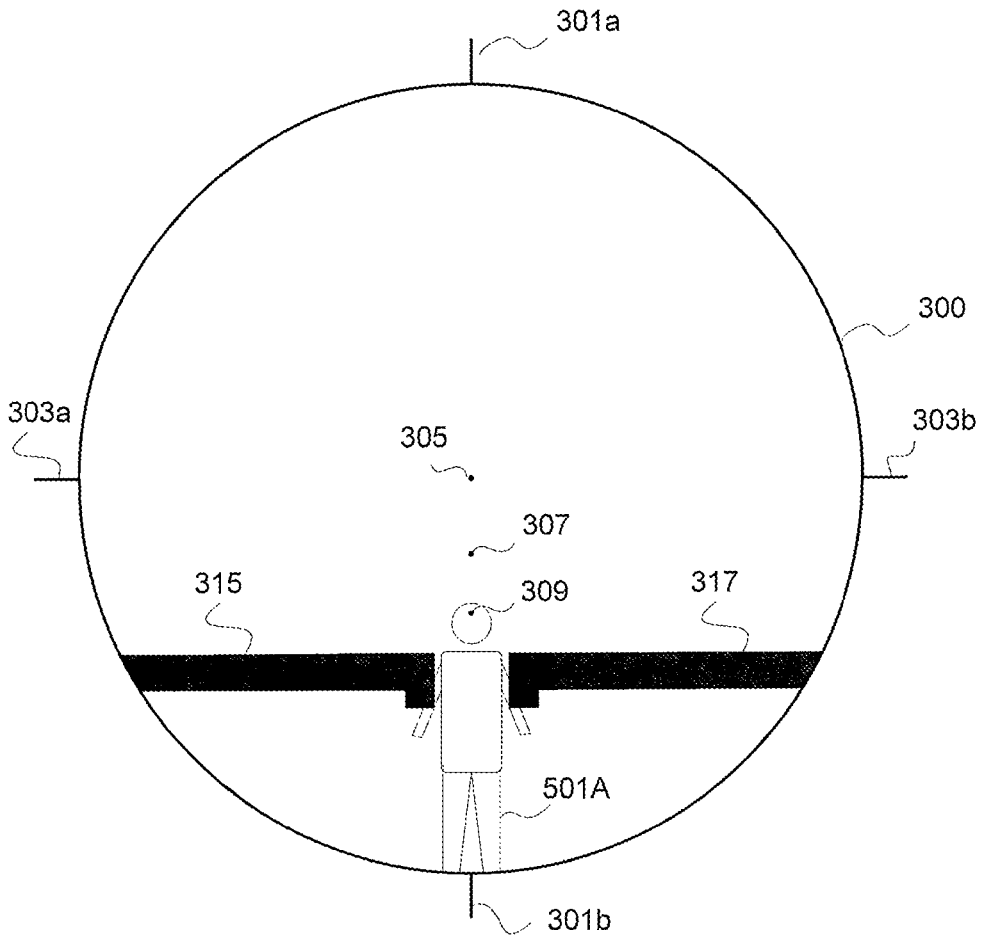
FIGS. 5A, 5B, and 5C illustrate a target range estimation methodology using a reticle according to the detailed description below when a target is in a standing position.
Figure 5B:
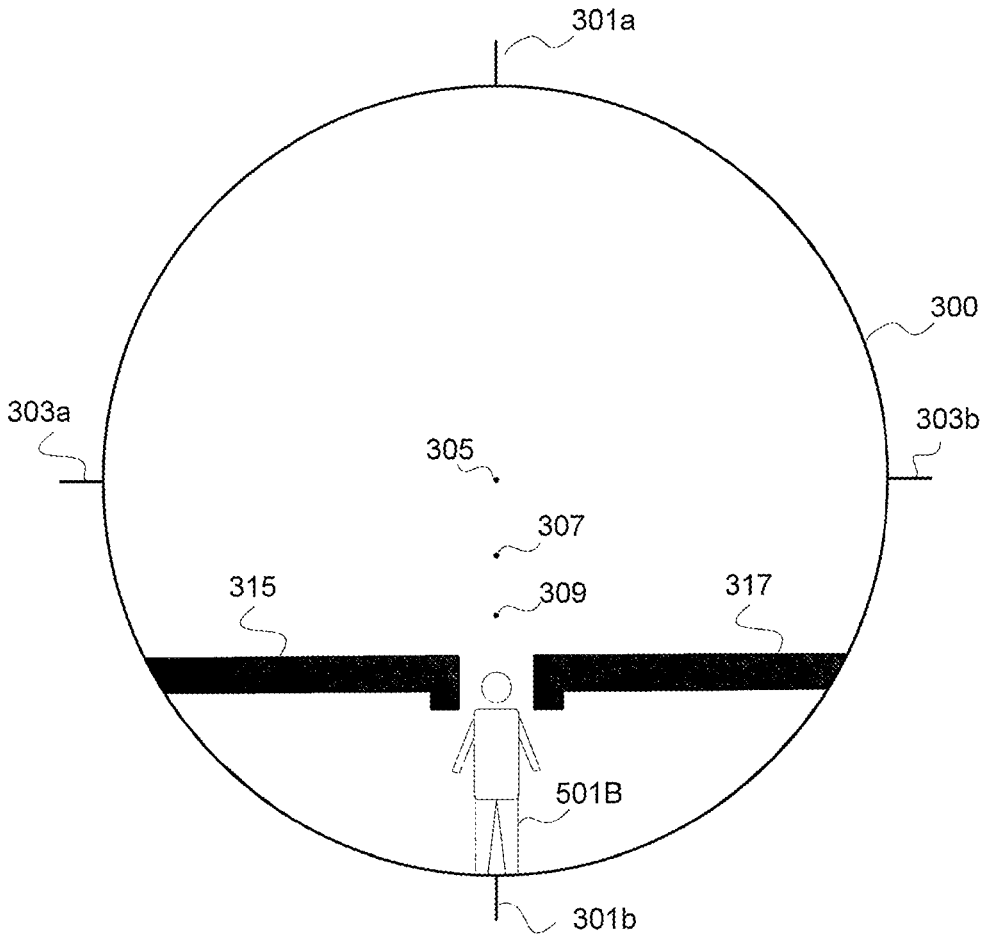
Figure 5C:
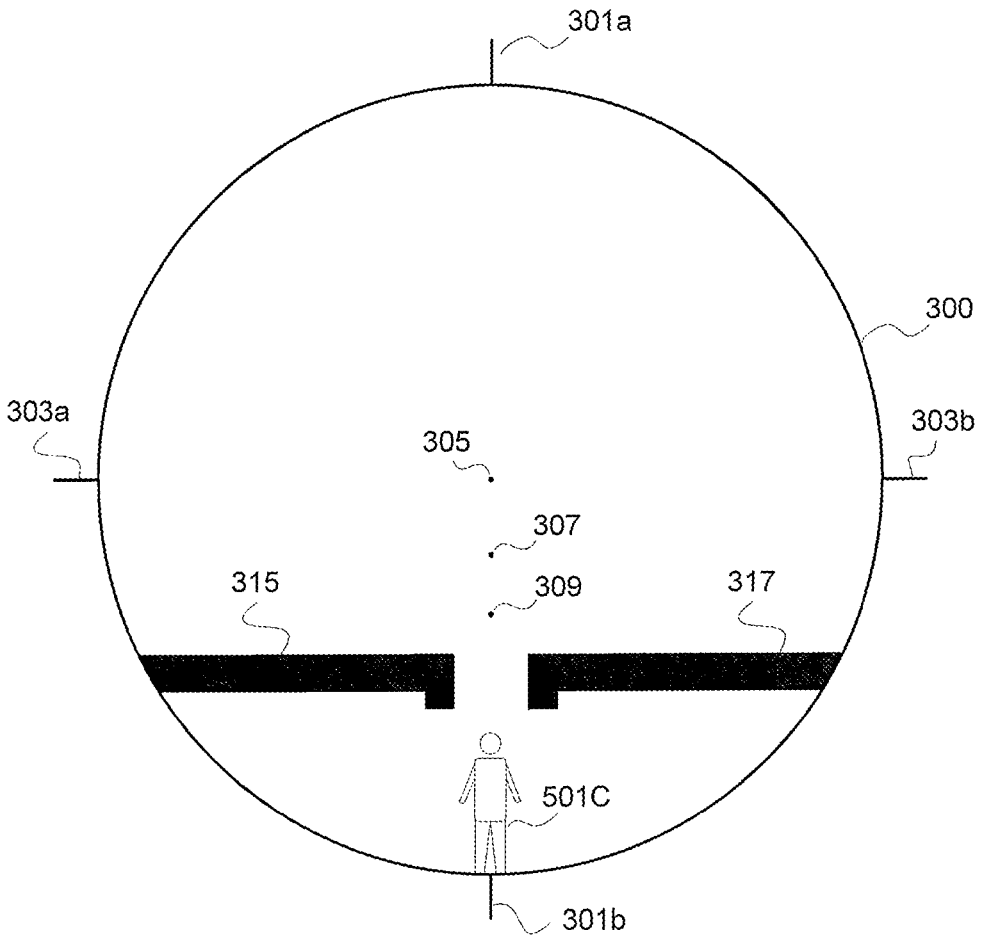

Referring to the embodiment illustrated in FIG. 3B, the stripes 315 and 317 serve at least two purposes—as a target distance estimation tool and wind compensation guide. The vertical distance "D" between the bottom of the circle 300 and the top of stripes 315 and 317 is calibrated such that it can be used as a target distance estimation tool. An exemplary method of estimating the target distance is illustrated in FIGS. 5A-5C and discussed later in the disclosure. For wind compensation, a gap "H" is provided between the left stripe 315 and the right stripe 317. The gap "H" enables an operator to apply basic wind holds at any of the intended distances.

The ballistic solution method used is based on the reticle dimensions. According to this disclosure, firing solutions are based on the ballistic calculation of a danger space, an optimized zero distance, a ballistic trajectory of ammunition, a target-distance to target-height ratio calculations, and a unit conversion formula such as from milradian (MIL) to minute-of-angle (MOA) or inches to MOA unit systems. The ballistic calculations can be performed using ballistic software. Consider for example, different ballistic characteristics of ammunitions used in a midrange (say 0-500 yards) weapon.

Each weapon-ammunition combination is likely to have a different danger space characteristic. The respective danger space characteristic can be analyzed, exploited and thereby correlated to a designated aiming reference within the reticle. This correlation is achieved through the manipulation of the zero distance. This will be illustrated and discussed in detail later using exemplary midrange weapon and ammunition ballistic trajectories.

Figure 4:
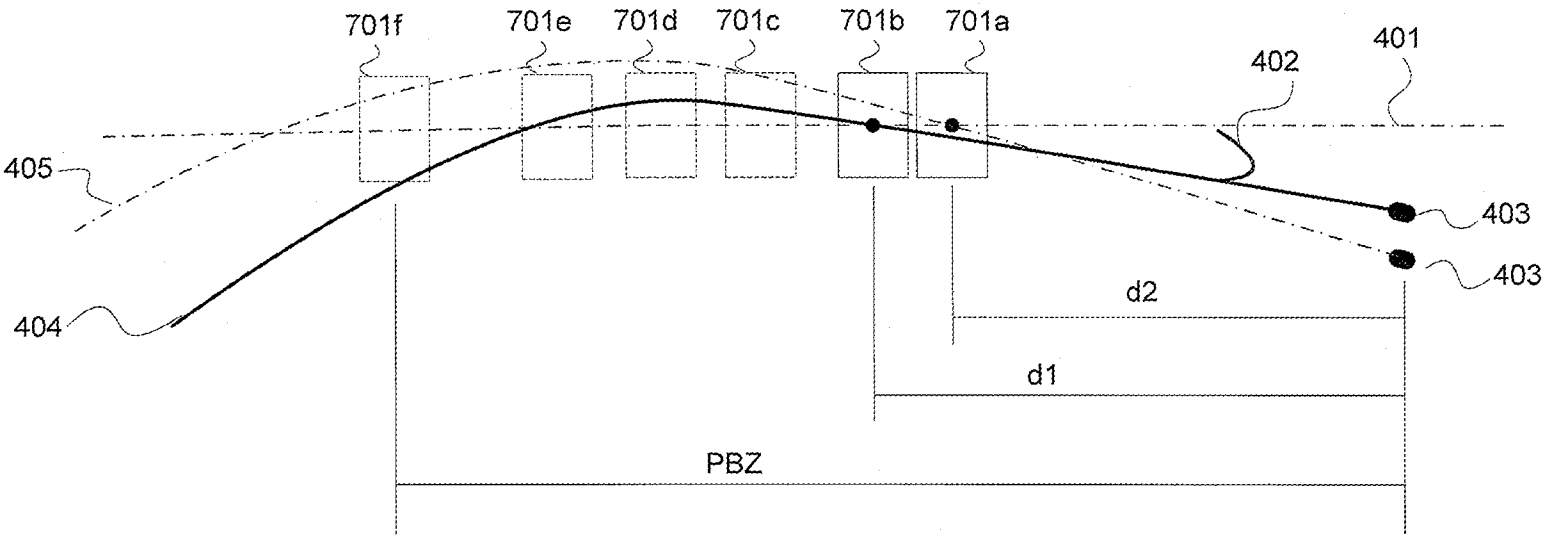
FIG. 4 illustrates example ballistic trajectories and their dependence on the angle of departure, and depicts an optimized zero distance schematic according to the detailed description below.

Referring to an exemplary illustration in FIG. 4, when an ammunition 403 is fired from a weapon it travels along a ballistic trajectory such as 404 or 405 depending on an angle of departure 402 of the ammunition 403. Horizontal distances "d1" and "d2" are distances from the operator to the first intersection of the line of sight 401 and the trajectories 404 and 405, respectively. Distances "d1" and "d2" are therefore zero distances for trajectories 404 and 405, respectively. A point blank horizontal distance (PBZ) is a distance range within which a target should always be hit without changing the angle of departure 402 of the ammunition 403.

The distance "d1" is an optimized zero distance since between the zero distance "d1" and the PBZ distance, the trajectory 404 of the ammunition 403 should always hit the target such that the ammunition trajectory has a maximized danger space. However, the distance "d2" is not an optimized zero distance since beyond the distance "d2" the target is missed at least once. For example, targets 701*d* and 701*e* are missed in FIG. 4.

Traditional zero distances (at least for military battle and law enforcement rifles) are typically generic 25, 50, or 100 meters. Traditional zero distances do not maximize the danger space. The zero distances historically are specific to a particular military weapon/ammunition combination. Once a weapon with a traditional sight has been zeroed, the ability of the operator to accurately hit a target beyond the zero distance is unreliable. The concept of the optimized zero (or manipulating zero distances) allows an operator to replicate closely ballistic trajectories with dissimilar weapons and/or ammunition (by manipulating the angle of departure through the zero distance rather than through an optical sight). In essence, the zero distance is manipulated until an ammunition impact location correlates to the reference primary aiming dots at the respective distance span.

The methodology of manipulating zero distance according to the present disclosure is a way of exploiting or maximized ballistic performance. There exist multiple different ammunition trajectories for any weapon-ammunition combination. An ammunition trajectory is a function of various parameters including angle of departure, ammunition weight, muzzle velocity, etc. According to the present disclosure, maximizing a danger space entails selecting a particular ammunition trajectory which covers a maximum horizontal distance within which a target 406 will be hit for the full range. For instance, in FIG. 4 the trajectory 404 has a zero distance d1 and covers a desired maximum horizontal distance PBZ, while hitting the targets 701*a*-701*f*. On the other hand, the trajectory 405 has a zero distance d2 and covers a longer horizontal distance than the trajectory 404, but misses the target at more than one location such as targets 701*d* and 701*e*. Hence, the distance d1 is the optimized zero distance.

Figure 7A:
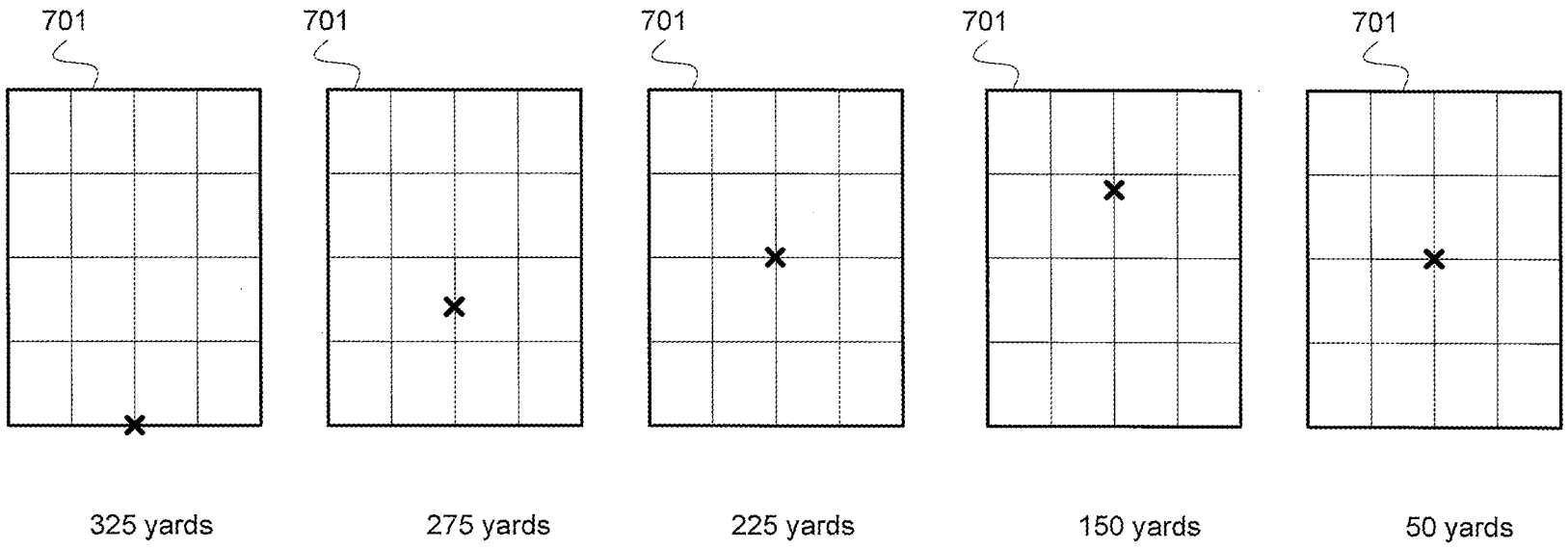
FIGS. 7A, 7B, and 7C illustrate a danger space determination methodology corresponding to different primary aiming dots of a reticle according to the detailed description below.
Figure 7B:
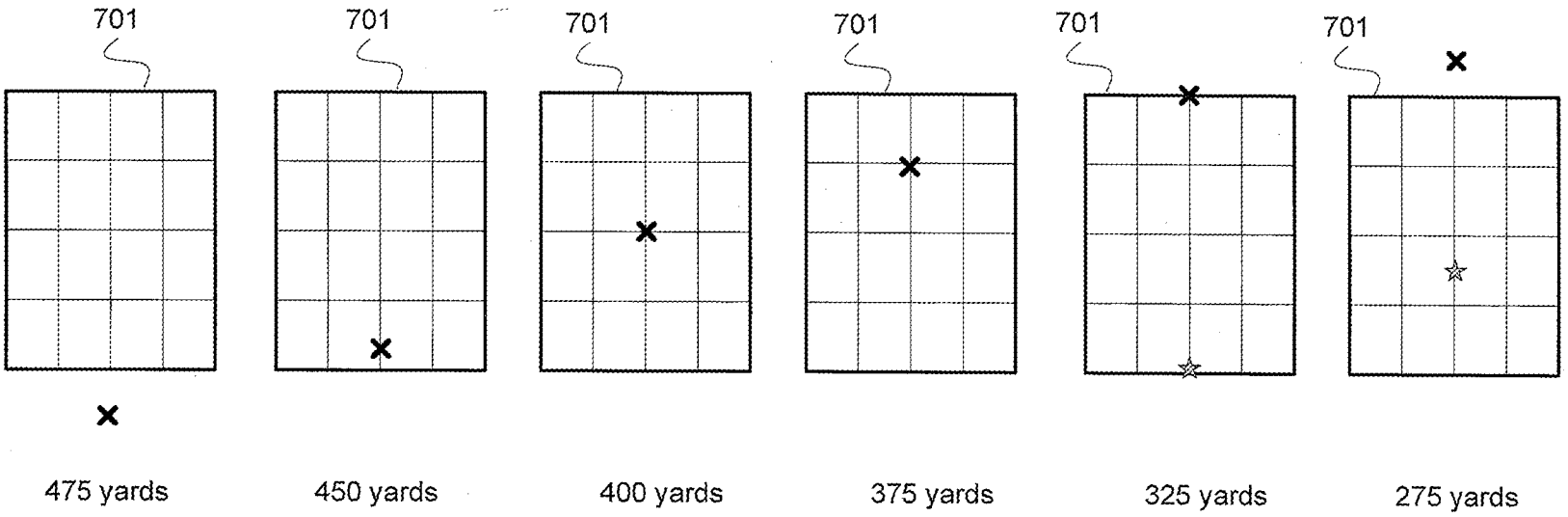
Figure 7C:
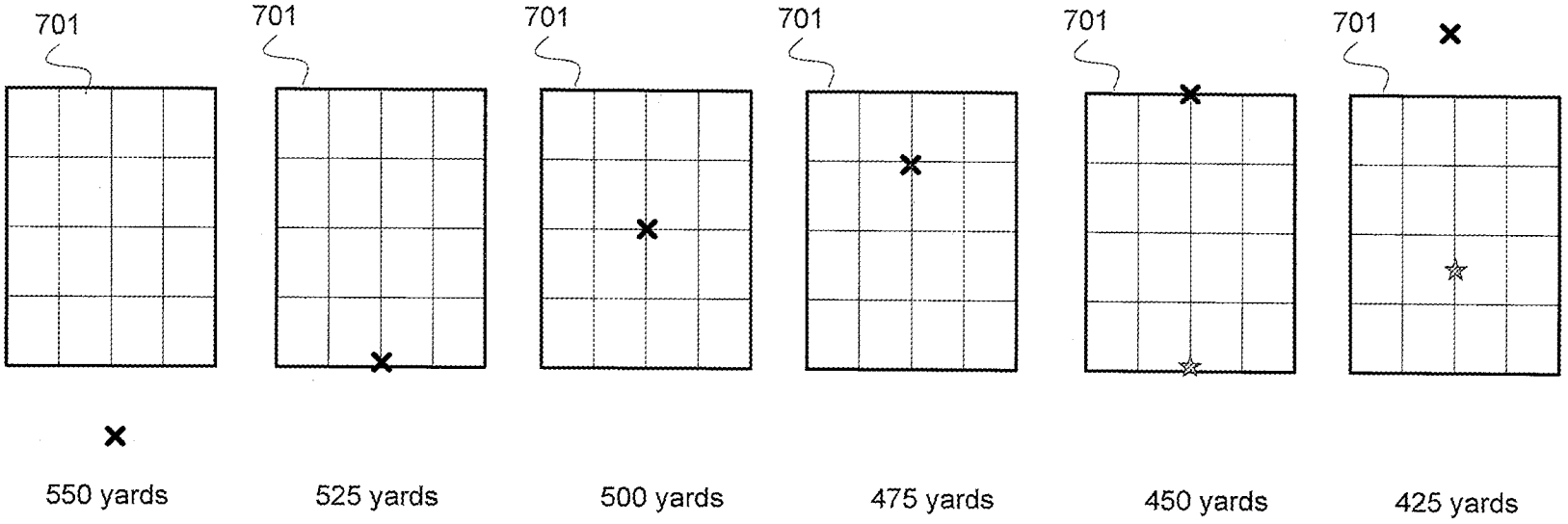

In addition to illustrating a danger space determination corresponding to the different primary aiming dots of the reticle, FIGS. 7A-7C illustrate the concept of different ammunition trajectories, and the distances each trajectory covers before hitting a target. According to an embodiment of this disclosure, an optimized zero distance d is calculated for first primary aiming dot 305 effectiveness at 300 yards or 300 yard PBZ, and is applied to zero a weapon-ammunition combination at the first primary aiming dot 305. For a greater angle of departure the optimized zero distance d is shorter. For slower or less efficient ammunition, the optimized zero is obtained by increasing the angle of departure and for faster and more efficient ammunition, vice versa. The optimized zero distance can be calculated in multiple ways. A combination of employing ballistic software and collecting data based on actual firing of ammunitions can be utilized.

A target-distance to target-height calculation is dependent on the optical lens assembly used, specifically the reticle. The target height (e.g., 68 inches) at a true distance (e.g., 300 yards) when viewed through an optical viewing device appears to be smaller (e.g., 21 inches). This image height in the optical viewing window is a function of several optical parameters such as a focal length of a lens, type of a lens, type of an optical assembly, magnification factor, etc. The target range can be calculated for an optical sight based on a conversion formula that includes variables such as a true target height, a distance to the target, an image height, magnification factor etc. For example, a HWS sight using a reticle according to this disclosure follows the conversion formula below:

$$\text{True target height@a distance to the target=image height} \quad (1)$$

Equation (1) applied to a true target height of 68 inches at various distances gives the following results:

68 inches@325 yards=20.91 inches (5.81 MILS@100 yards)

68 inches@400 yards=15.96 inches (4.36 MILS@100 yards)

68 inches@450 yards=15.12 inches (4.2 MILS@100 yards)

24 inches@333 yards=7.2 inches (2 MILS@100 yards)

24 inches@430 yards=5.58 inches (1.55 MILS@100 yards)

24 inches@444 yards=5.58 inches (1.5 MILS@100 yards)

Similar target height, target distance and image height related calculations can be used to determine the dimensions of reticle features according to the present disclosure.

Referring to FIG. 3B, an exemplary reticle design for an HWS of a midrange weapon (e.g., for 0-500 yards) is discussed. The diameter A of the circle 300 is chosen to be 71.633 MOA (75 inches at 100 yards) and the straight lines 301*a*, 301*b*, 303*a*, and 303*b* of equal dimension B equal to 4 MOA (4.188 inches at 100 yards). Dimensions and relative locations of the primary aiming dots 305, 307, and 309 and stripes 315 and 317 can be determined based on ballistic characteristics obtained for different ammunitions using ballistic software, the danger space calculations described herein, and a target size. The military standard for a target size is the 24" standard and generally corresponds to a median torso size based on anthropomorphic data.

For a midrange weapon (say for 0-500 yards), the primary aiming dot 305 is marked at the center of the circle 300 at a distance C, which will be diameter A divided by 2 (equaling 35.815 MOA). Further, according to the ballistic solution method of this embodiment, the primary aiming dot 305 is designed to be used for a target in the range of 0-325 yards. The primary aiming dot 307 is marked at a distance F of 2 MILS (7.2 inches at 100 yards) below the primary dot 305 with reference to the figure caption in FIG. 3B. Then, based on the ballistic solution, the primary aiming dot 307 is designed to be used for a target in the range of 325-450 yards. The primary aiming dot 309 is marked at a distance G of 3.55 MILS (12.78 inches at 100 yards) below the primary dot 305. Then, according to the ballistic solution method of this embodiment, the primary aiming dot 309 is designed to be used for a target in the range of 450 yards and farther.

Referring back to FIG. 3B, for a midrange weapon reticle, the dimensions and locations of the stripes 315 and 317 can be determined as follows. The top surface of the stripes 315 and 317 is provided at a vertical distance D from the bottom of the circle 300, which is approximately one fourth of the diameter A of the circle 300. In this example, the distance D is 5.81 MILS (20.91 inches at 100 yards). The bottom surface of the stripes 315 and 317 is at a distance E, which is approximately one third of the diameter A. In this example, the distance E is 4.2 MILS (15.12 inches at 100 yards).

Before selecting one of the primary aiming dots 305, 307, and 309 to engage a target, the measuring tool functionality of the primary dots and the stripes can be exploited. The use of the measuring tool functionality is illustrated in FIGS. 5A-5C and FIGS. 6A-6C.

Referring to FIGS. 5A-5C, if a target 501A of height of approximately 68" is in an upright position then the target range is estimated using the stripes 315 and 317 followed by selection of one of the primary aiming dots 305, 307, and 309 (e.g., center aiming dot, second aiming dot, third aiming dot). The range estimation for the upright target in this embodiment is performed as follows. Position the target 501A along the vertical center axis with its feet touching the bottom of the circle 300. If the target height in the reticle is above the top surface of the stripes, then the target is between 0-325 yards. Thus, the target 501A can be engaged with the primary aiming dot 305.

Referring to FIG. 5B, again positioning the target 501B along the imaginary vertical center axis with its feet touching the bottom of the circle 300, if the target height in the reticle is below the top surface and above the bottom surface of the stripes 315 and 317 then the target is between 300-450 yards. Thus, the target can be engaged using the primary aiming dot 307.

Referring to FIG. 5C, again positioning the target 501C along the imaginary vertical center axis with its feet touching the bottom of the circle 300, if the target height in the reticle is below the bottom surface of the stripes then the target is 450 yards or beyond. Thus, the target can be engaged using the primary aiming dot 309.

Figure 6A:
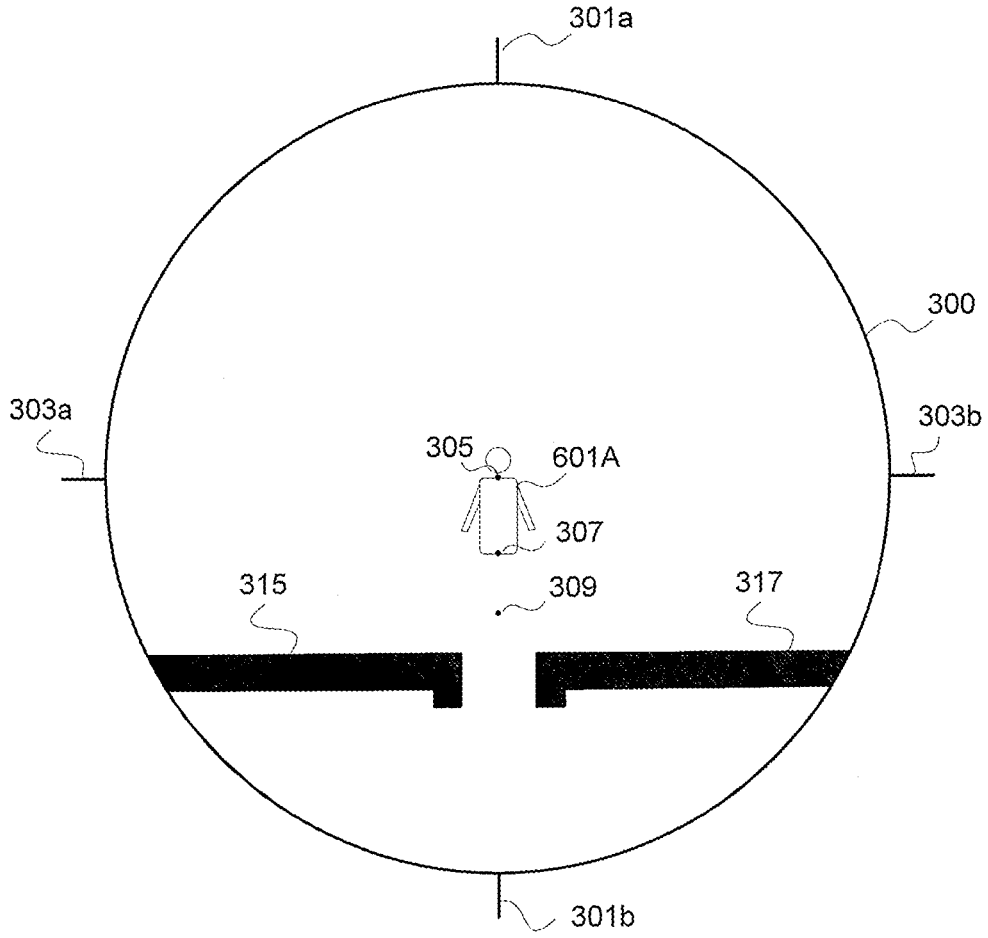
FIGS. 6A, 6B, and 6C illustrate a target range estimation methodology using a reticle according to the detailed description below when a target is partially concealed, or kneeling.
Figure 6B:
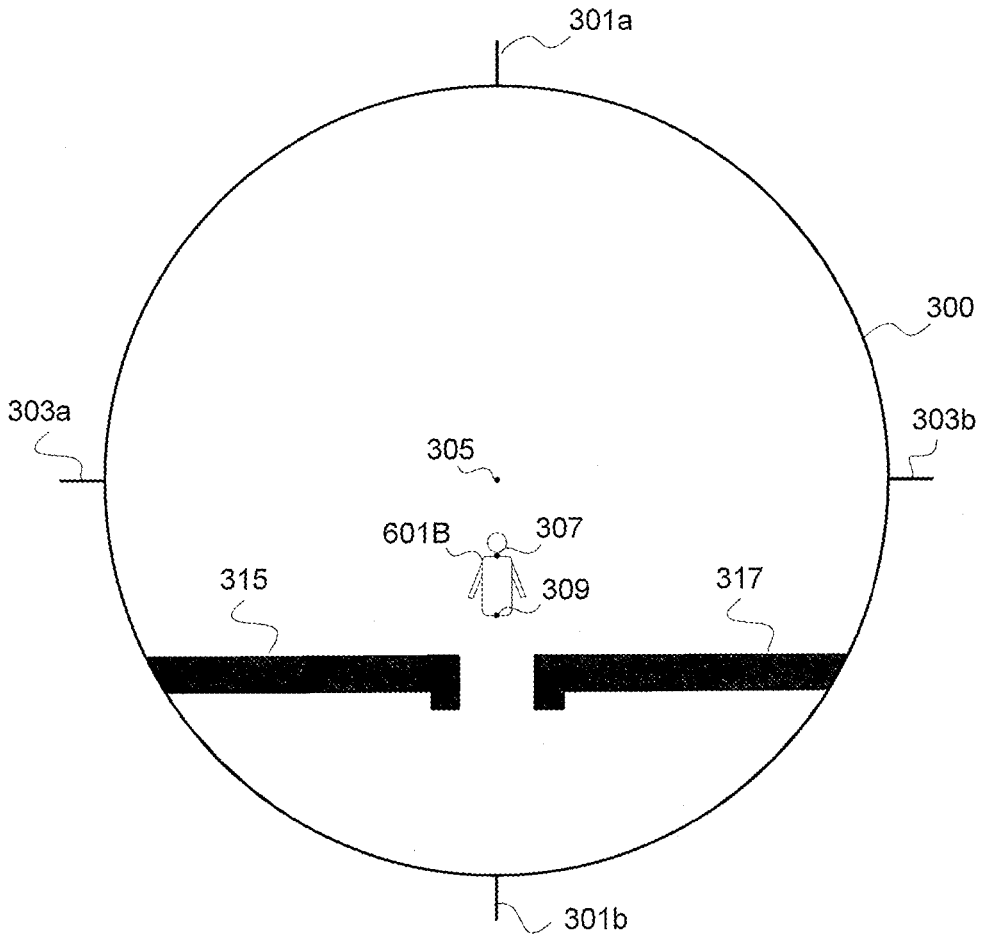
Figure 6C:
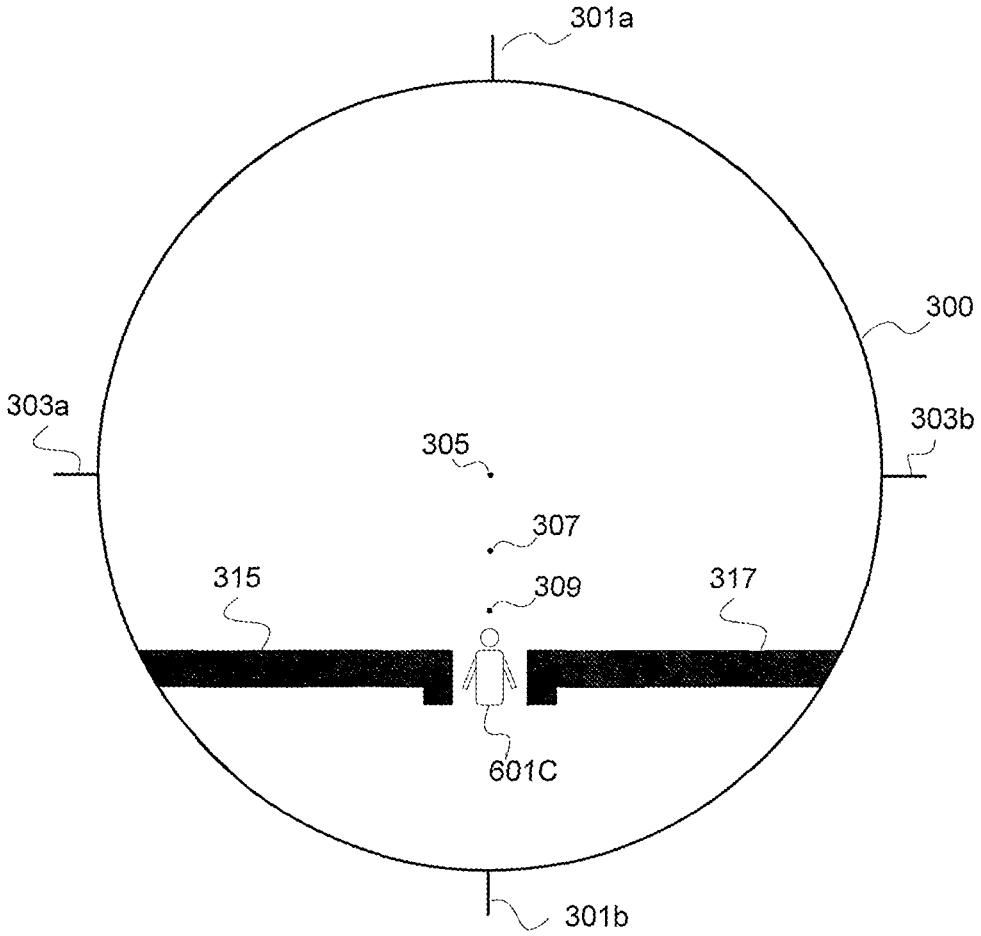

Referring to FIGS. 6A-6C, if a target 601A is concealed or is in a kneeling position, then the target range is estimated using the distance between the dots 305, 307, and 309 and the stripes 315 and 317 followed by selection of one of the primary aiming dot 305, 307, and 309. The range estimation for the kneeling target 601A is performed as follows. Position the vital part of the target 601A (e.g., the human torso) along the imaginary vertical center axis. If the entire vital part of the target 601A seen in the reticle can be placed only between the primary aiming dots 305 and 307, then the target is between 0-325 yards. Thus, the target can be engaged using the primary aiming dot 305.

Referring to FIG. 6B, again positioning the vital part of the target 601B along the imaginary vertical center axis, if the entire vital part of the target 601B seen in the reticle can be placed substantially between the primary aiming dots 307 and 309, then the target is between 325-450 yards. Thus, the target can be engaged using the primary aiming dot 307.

Referring to FIG. 6C, again positioning the vital part of the target 601C along the imaginary vertical center axis, if the entire vital part of the target 601C seen in the reticle can be placed only between the top surface and the bottom surface of the stripes, then the target is beyond 450 yards. Thus, the target can be engaged using the primary aiming dot 309.

Figure 8:
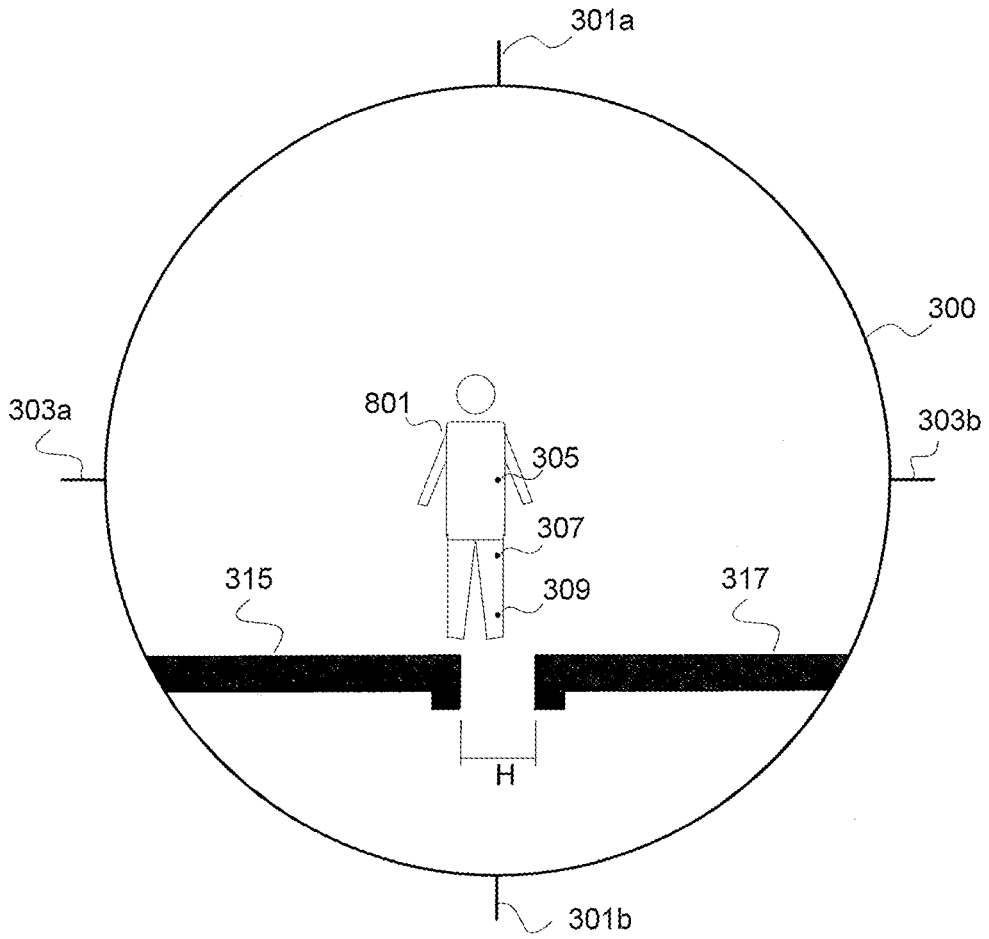
FIG. 8 illustrates a windage compensation hold methodology for wind blowing from the left to the right side of an operator.

FIG. 8 illustrates an exemplary embodiment of a windage compensation feature. The ballistic characteristic of an object such as ammunition or a golf ball is affected by the wind. Hence, windage compensation is applied for accurate target engagement. According to an embodiment of the present disclosure, windage compensation is accomplished using a gap "H" of the reticle 300 provided between the left side stripe 315 and the right side stripe 317. The dimension of the gap "H" compensates for the wind blowing around 6 mph. If the wind is blowing from the left side to right side of the operator, then the target position 801 is offset to the left of the vertical center axis within the gap "H", while maintaining the selection of the primary aiming dots 305, 307 or 309 in case of no wind. Once the correct primary aiming dot is identified, the target can be further laterally indexed on the horizontal plane of the reference marks to compensate for greater or lesser wind compensation.

The target range for each primary aiming dot can be determined using a danger space calculation according to the present disclosure. Example danger space calculations are illustrated in FIGS. 7A-7C wherein the rectangles 701 respectively represent the 24" standard. The grid within each rectangle 701 is for reference purposes. A cross mark "X" represents sample points along an ammunition trajectory, and when viewed with reference to a target in sight refers to a point of impact. Further, a sequence of cross marks, viewed from right to left in FIGS. 7A-7C, represents an ammunition trajectory that correlates to a particular primary aiming dot (e.g., primary aiming dot 305). In these illustrations, it is assumed that the performance characteristics of the specific weapon/ammunition combination are maximized with a 40 yard optimized zero (in order to afford 0-325 yard engagement on the 24" standard using the first primary aiming dot 305). Also, it is assumed that a primary aiming dot 305 is positioned at the center of a target before firing the ammunition.

FIG. 7A illustrates a danger space that correlates to the primary aiming dot 305 of the reticle. The danger space in this illustration is a range from 0 to 325 yards, since the point of impact (cross mark "X") is on the target for this range (i.e., within each of the rectangles 701). When the primary aiming dot 305 is employed to engage a target, the trajectory of the ammunition is such that at 50 yards the point of impact is at the center of the target. In this example, as the horizontal distance increases from 50 to 150 yards, the vertical point of impact rises relative to the center of the target and reaches a maximum vertical distance. Thereafter, the vertical point of impact falls until it again crosses the center of the target at 225 yards and eventually misses the target altogether beyond a horizontal distance of 325 yards. From this illustration it can be understood that, when the primary aiming dot 305 is employed, a target in the range 0-325 yards should always be hit.

FIG. 7B illustrates an exemplary danger space corresponding to the primary aiming dot 307 of the reticle. Again, the ammunition trajectory is represented by a sequence of cross marks read from right to left and representing a distance of 275 to 475 yards. Within this range, the vertical point of impact drops continuously. The danger space in this illustration is a range from 325-450 yards. The points of impact represented by the star marks correspond to the ammunition trajectory when the primary aiming dot 305 (indication omitted) was employed to engage a target. As can be seen from FIG. 7B, at a horizontal distance of 325 yards both primary aiming dots 305 and 307 can be employed to engage the target. As such, a minor error in target range estimation can be tolerated.

In FIG. 7B, when the primary aiming dot 307 is employed to engage a target at 275 yards, the point of impact (cross mark) is above the target, and thus the target is said to be missed. As the horizontal distance increases the vertical point of impact is lowered, as represented by the sequence of cross marks read from right to left in the figure. For example, if the target is at 325 yards, the point of impact (cross mark) is higher than the center of the target. If the target is at 400 yards, the point of impact is at the center of the target. If the target is at 450 yards, the point of impact is lower than the center of the target and at the lowest part of the target. Beyond 450 yards the point of impact is below the target and the target is thus missed. From this illustration, it can be understood that, when the primary aiming dot 307 is employed, a target in the range of 325-450 yards should always be hit, and hence that range is the danger space correlated to the primary aiming dot 307.

Further in FIG. 7B, the star marks at 275 yards and at 325 yards respectively denote the point of impact when primary aiming dot 305 was employed. Around 325 yards both primary aiming dots 305 and 307 can be employed to engage the target.

FIG. 7C illustrates an exemplary danger space corresponding to the primary aiming dot 309 of the reticle. Again, the ammunition trajectory is represented by a sequence of cross marks read from right to left and representing a distance from 425 to 550 yards. Within this range, the vertical point of impact drops continuously. The danger space in this illustration is a range from 450 to 525 yards. The points of impact represented by the star marks correspond to ammunition trajectory when primary aiming dot 307 is employed to engage a target. As can be seen from FIG. 7C, at a horizontal distance of 450 yards, both primary aiming dots 307 and 309 can be employed to engage the target. As such, a minor error in target range estimation can be tolerated.

In FIG. 7C, when the primary aiming dot 309 is employed to engage a target at 425 yards, the point of impact (cross mark) is above the target and the target is said to be missed. As the horizontal distance increases the vertical point of impact is lowered, as represented by a sequence of cross marks read from right to left in the figure. For example, if the target is at 450 yards, the point of impact is higher than the center of the target and on the target. If the target is at 475 yards the point of impact "X" is higher than the center of the target, but lower than the point of impact for shorter distances such as 425 yards. If the target is at 500 yards, the point of impact is at the center of the target. If the target is at 525 yards, the point of impact is at bottom of the target. Beyond 525 yards the point of impact is below the target and the target is thus missed. From this illustration it can be understood that, when the primary aiming dot 309 is employed, a target in the range 450-525 yards should be hit, and hence that range is the danger space correlated to the primary aiming dot 309.

Further, in FIG. 7C, the star marks at 425 yards and at 450 yards respectively denote the point of impact when primary dot 307 is employed.

The overlapping danger space corresponding to the primary aiming dots 305 and 307 and the primary aiming dots 307 and 309, respectively, allows for an error in estimation of the target range or minor deviation in target size. Thus, decreasing the likelihood that the target will be missed when the operator makes a minor error in estimating the target range.

Example weapons, average muzzle velocities and zeroed distances in accordance with embodiments of the present disclosure are listed in Chart 1, reproduced directly below. It is to be appreciated that the reticles, sights, approaches, techniques, and methods described herein can be used with a variety of weapons and the following is not a restrictive listing.

CHART 1

Example Weapons and Optimized Zeros

| Weapons Utilized | Muzzle Velocity Average | Optimized Zero Distance |
|---|---|---|
| Colt M4 (14.5") | 2600 FPS | 40 Yards |
| Noveske (10.5") | 2400 FPS | 27 Yards |
| Noveske (12.5") | 2480 FPS | 32 Yards |
| Colt901 - (7.62 mm, 13") | 2340 FPS | 35 Yards |

As noted above, altitude, temperature change, and other situational differences can be considered in conjunction with the reticles, sights, approaches, techniques, and methods described herein. Chart 2, directly below provides sample data for a Colt M4 (Colt's Manufacturing Company LLC, Hartford Conn.). Once again is to be appreciated that the reticles, sights, approaches, techniques, and methods described herein are not restricted to implementation with a particular weapon and ammunition combination. The following information is for exemplary purposes only. Charts 3 and 4 are provided for additional information about ballistics characteristics of different weapon/ammunition combinations for various environmental conditions using a second and third dot.

CHART 2

Example Weapon Performance Characteristics Colt M4/ Speer Gold Dot LE

| Weapon: | Ammunition: |
|---|---|
| Colt M4 (14.5"); 2600 FPS; 40 yard optimized zero; 3.0" BH, 1 in 7" RH twist | .223 Speer Gold Dot LE - 64 grain SP, G1 = .233 (Speer Ammo, Lewiston ID) |
| High Elevation, Moderate Temperature | Low Elevation, Cold Temperature |
| Ambient Temperature - 80 F. | Ambient Temperature - 0 F. |
| Altitude - 4000 ft. ASL | Altitude - 0 ft. ASL |
| Ballistics: | Ballistics: |

CHART 2-continued

| Example Weapon Performance Characteristics Colt M4/ Speer Gold Dot LE | |
|---|---|
| 100 Yard Point of Impact - +.76 MIL (2.76" H) | 100 Yard Point of Impact - +.75 MIL (2.7" H) |
| 200 Yard Point of Impact - +.28 MIL (2.01" H) | 200 Yard Point of Impact - +.16 MIL (1.15" H) |
| 300 Yard Point of Impact - −.69 MIL (7.45" L) | 300 Yard Point of Impact - −1.02 MIL (11.01" L) |
| 400 Yard POI (2nd Dot) - +0.04 MIL (.57" H) | 400 Yard POI (2nd Dot) - −.70 MIL (10.08" L) |
| 500 Yard POI (3rd Dot) - −0.03 MIL (.54" L | 500 Yard POI (3rd Dot) - −1.45 MIL (26.1" L) |
| | 500 Yard POI (Cold Hold Line) - .45 MIL (8.1" L) |

CHART 3

Example Performance Characteristics
Colt 901/Federal Tactical Bonded ($3^{rd}$ Dot)

Weapon:
Colt 901 (13"); 2340 FPS; 35 yard optimized zero; 3.0" BH/1 in 12" RH twist
Ammunition:
Federal Tactical Bonded - .308 /165 grain/ G1 = .350
Environmental Conditions
Ambient Temperature - 77 F.
Altitude - 4000 ft. ASL

| Distance (yards) | Trajectory $3^{rd}$ dot |
|---|---|
| 550 | 15.44 inches (L) |
| 525 | 6.61 inches (L) |
| 500 | 1.08 inches (H) |
| 475 | 7.69 inches (H) |
| 450 | 13.44 inches (H) |
| 425 | 18.20 inches (H) |

CHART 4

Example Performance Characteristics Colt 901/Federal Tactical Bonded ($2^{nd}$ Dot)

| Weapon: Colt 901 (13"); 2340 FPS; 35 yard optimized zero; 3.0" BH / 1 in 12" RH twist Ammunition: Federal Tactical Bonded - .308 / 165 grain / G1 = .350 | | Environmental Conditions Ambient Temperature - 77F Altitude - 4000 ft. ASL | |
|---|---|---|---|
| Distance (yards) | Trajectory $2^{nd}$ dot | Distance (yards) | Trajectory $2^{nd}$ dot |
| 475 | 18.81 inches (L) | 350 | 8.19 inches (H) |
| 450 | 11.66 inches (L) | 325 | 11.7 inches (H) |
| 425 | 5.50 inches (L) | 300 | 13.71 inches (H) |
| 400 | POA/POI | 275 | 15.24 inches (H) |
| 375 | 4.32 inches (H) | | |

Figure 9:
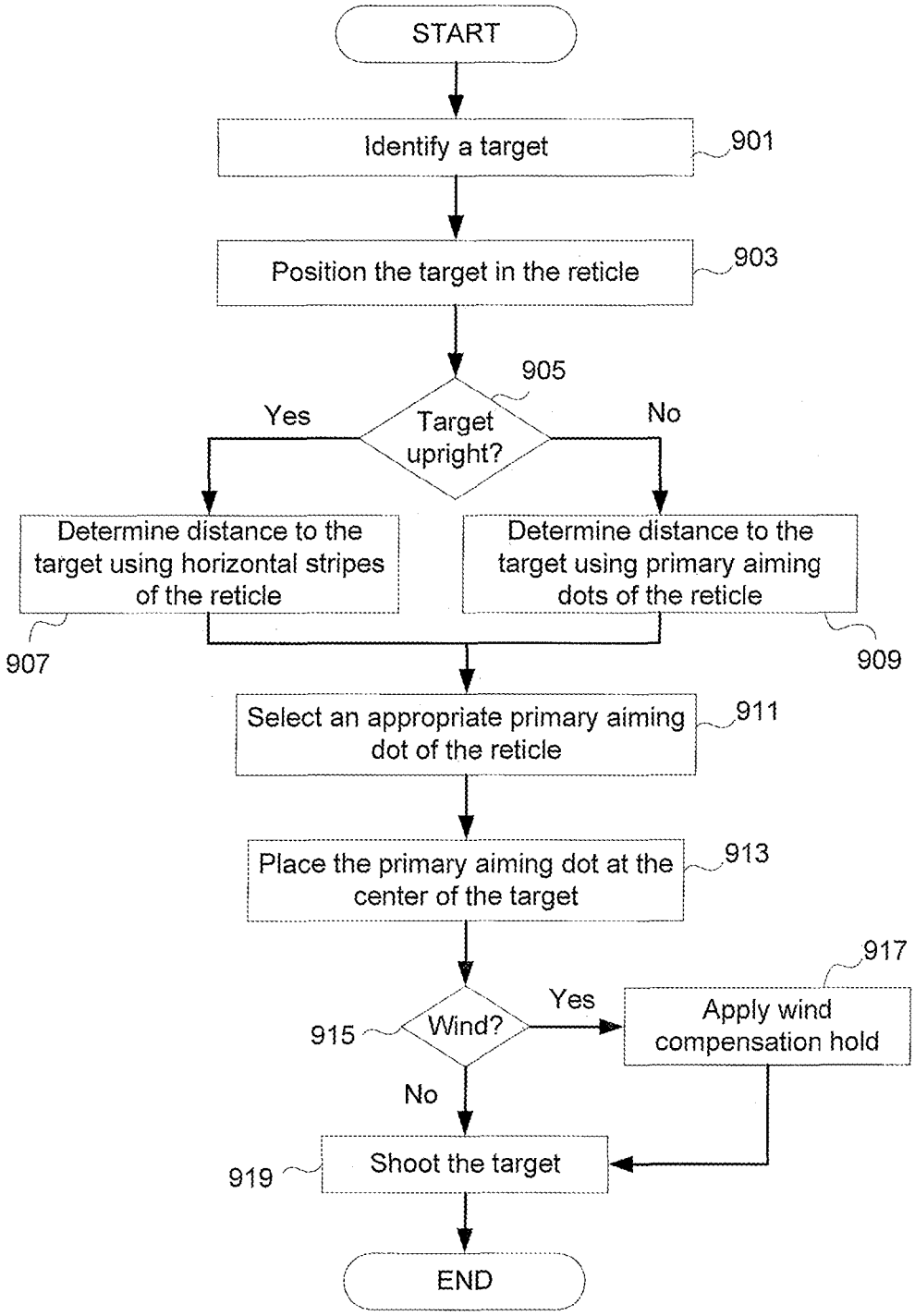
FIG. 9 is a flowchart illustrating a procedure for using a reticle according to the detailed description below.

A method an operator employs when using a reticle according to the present disclosure is illustrated in FIG. 9. The process starts in step 901 when an operator identifies a target using a weapon sight. In step 903, the target is positioned inside the circle of a reticle of the sight. If the target is determined to be in an upright position in step 905, then the operator determines the distance to the target using horizontal striped markings of the reticle in step 907. If it is determined in step 905 that the target is not in the upright position, then the operator determines the distance to the target using primary aiming dot markings of the reticle in step 909.

Once the distance to the target is determined in step 909, the operator selects an appropriate primary aiming dot marking of the reticle to place on the target in step 911. For example, referring to FIG. 3B, if the distance to the target is within the range of 0 to 325 yards, then the primary aiming dot 305 is selected. If the distance to the target is within the range of 325 to 450 yards, then the primary aiming dot 307 is selected. For target at a distance of 450 yards or beyond, primary aiming dot 309 is selected.

The selected primary aiming dot is placed at the center of the target in step 913. A determination is made whether wind is a factor in step 915. If wind is a factor which requires compensation, then a wind compensation hold is applied in step 917. If wind is of limited or no concern, then wind compensation using the reticle is not required. Finally, the weapon is fired at the target in step 919.

The reticle designed using the ballistic method discussed in this disclosure is exemplary. Alternate reticle designs may include different patterns with similar functionality. For example, the imaginary vertical and horizontal axes may be explicitly marked. The left and the right side of the primary aiming dots may include additional marks in the form of dots, lines or the like, which may be oriented horizontally, vertically, inclined or a combination thereof. The markings may be spaced apart from each other or shaded to form a "strip". The reticle designed using the ballistic method of this disclosure can also be implemented in a non-HOLO graphic sight.

Although the subject matter has been described in language specific to structural features and/or methodological steps, it is to be understood that the subject matter defined in the appended claims is not necessarily limited to the specific features or steps described. Rather, the specific features and steps are disclosed as example forms of implementing the claimed subject matter.

What is claimed is:

1. A method for using a reticle including a plurality of aiming marks and first and second horizontal stripes provided on each side of the plurality of aiming marks respectively, the plurality of aiming marks include a first mark positioned at the center of the reticle and at least one additional mark spaced below the first mark along a vertical center axis of the reticle, adjacent marks of the first mark and the at least one additional mark are spaced apart by predetermined distances, the first and second horizontal stripes offset relative to the vertical center axis with a gap provided therebetween and extending towards the perimeter of the reticle, and the first and second horizontal stripes spaced a predetermined distance from a bottom of the reticle measured along the vertical center axis, the method comprising:

positioning a target in the reticle;

determining a distance to the target using at least one of the spacing between the horizontal stripes and the spacing between the adjacent marks;

selecting an appropriate primary aiming mark from the plurality of primary aiming marks based on the determined distance to the target;

positioning the selected primary aiming mark at a center of the target; and shooting the target.

2. The method according to claim 1, further comprising applying a wind compensation hold by moving the weapon in a horizontal plane positioning the target within the gap between the first and second horizontal stripes.

3. The method according to claim 1, wherein the predetermined distances spacing the adjacent aiming marks are determined using a danger space analysis for a plurality of weapons and a plurality of ammunitions combinations.

4. The method according to claim 1, further comprising calibrating the reticle for a particular weapon and ammunition combination by zeroing the weapon using the first primary aiming dot.

5. The method according to claim 1, wherein the predetermined distance from the bottom of the reticle is determined using a distance-to-height ratio and a conversion formula for a plurality of weapons and a plurality of ammunitions combinations.

6. The method according to claim 1, wherein the reticle is implemented in a holographic weapon sight.

7. The method according to claim 1, wherein the reticle is implemented in an optical sight.

8. The method according to claim 1, wherein a danger space corresponding to one of the plurality of primary aiming dots overlaps a danger space corresponding to an adjacent primary aiming dot.

9. The reticle according to claim 1, further comprising using the width of the horizontal stripes to determine the height of an object.

* * * * *